US011005188B2

(12) United States Patent
Cohen et al.

(10) Patent No.: US 11,005,188 B2
(45) Date of Patent: May 11, 2021

(54) ENHANCED ANTENNA SYSTEMS

(71) Applicant: Fractal Antenna Systems, Inc., Bedford, MA (US)

(72) Inventors: Nathan Cohen, Belmont, MA (US); Justin Mitchell, Waltham, MA (US)

(73) Assignee: Fractal Antenna Systems, Inc., Bedford, MA (US)

( * ) Notice: Subject to any disclaimer, the term of this patent is extended or adjusted under 35 U.S.C. 154(b) by 81 days.

(21) Appl. No.: 16/339,878

(22) PCT Filed: Oct. 5, 2017

(86) PCT No.: PCT/US2017/055367

§ 371 (c)(1),
(2) Date: Apr. 5, 2019

(87) PCT Pub. No.: WO2018/067835

PCT Pub. Date: Apr. 12, 2018

(65) Prior Publication Data

US 2020/0044352 A1 Feb. 6, 2020

Related U.S. Application Data

(60) Provisional application No. 62/404,273, filed on Oct. 5, 2016.

(51) Int. Cl.
*H01Q 19/10* (2006.01)
*H01Q 15/00* (2006.01)
(Continued)

(52) U.S. Cl.
CPC ..... *H01Q 15/0093* (2013.01); *H01P 1/2005* (2013.01); *H01Q 9/06* (2013.01);
(Continued)

(58) Field of Classification Search
CPC .... H01Q 15/0093; H01Q 9/065; H01Q 19/10; H01Q 5/00; H01Q 19/185; H01Q 15/0086; H01P 1/2005
(Continued)

(56) References Cited

U.S. PATENT DOCUMENTS 5,450,053 A * 9/1995 Wood ..... G01J 5/20 250/250
6,127,977 A * 10/2000 Cohen ..... H01Q 1/36 343/700 MS
(Continued)

OTHER PUBLICATIONS

International Search Report dated Apr. 12, 2018 for international application PCT/US2017/055367 filed Oct. 5, 2017, 11 pages.
(Continued)

*Primary Examiner* — Hai V Tran
(74) *Attorney, Agent, or Firm* — Cesari and McKenna, LLP

(57) ABSTRACT

Antenna systems are described which provide means of mitigating the undesirable transmission line effect(s) by using fractal metamaterials in close proximity to an antenna, with both the antenna and fractal metamaterials being positioned a conductive surface, which may be inside or adjacent to a cavity. The fractal metamaterial can include an array of close spaced (e.g., less than 1/10 wavelength separation) resonant structures of a fractal shape, resonant at or near the intended frequency of use of the antenna. The fractal metamaterial can reverse the phase of the reflected wave so that the metal cavity no longer produces an out of phase current induced by the antenna. Without the cavity being out of phase to the antenna, the transmission line effect is mitigated substantially and the antenna performance can accordingly be enhanced. Further embodiments omit a cavity and locate a fractal metamaterial and antenna(s) adjacent to an underlying conductive surface.

6 Claims, 3 Drawing Sheets

(51) Int. Cl.

| | |
|---|---|
| ***H01Q 9/06*** | (2006.01) |
| ***H01Q 19/185*** | (2006.01) |
| ***H01P 1/20*** | (2006.01) |
| *H01Q 5/00* | (2015.01) |

(52) U.S. Cl.
CPC ..... *H01Q 9/065* (2013.01); *H01Q 15/00* (2013.01); *H01Q 15/0086* (2013.01); *H01Q 19/10* (2013.01); *H01Q 19/185* (2013.01); *H01Q 5/00* (2013.01)

(58) Field of Classification Search
USPC ..... 343/789
See application file for complete search history.

(56) References Cited

U.S. PATENT DOCUMENTS 6,445,352 B1 * 9/2002 Cohen ..... H01Q 1/242 343/745
6,451,553 B1 * 9/2002 Olsen ..... A21D 2/265 435/267
10,103,445 B1 * 10/2018 Gregoire ..... H01Q 13/18
2002/0149519 A1 * 10/2002 Varadan ..... H01Q 9/40 343/700 MS
2005/0151697 A1 * 7/2005 Cohen ..... H01Q 9/42 343/793
2005/0237238 A1 * 10/2005 Rahola ..... H01Q 7/00 343/700 MS
2007/0126637 A1 * 6/2007 Habib ..... H01Q 9/36 343/700 MS
2015/0314526 A1 * 11/2015 Cohen ..... H01Q 1/00 343/907
2017/0365931 A1 * 12/2017 Martel ..... H01Q 1/521

OTHER PUBLICATIONS

Zhong, Yong-Wei et al., "Gain enhancement of bow-tie antenna using fractal wideband artificial magnetic conductor ground" Electronics LET, IEE Stevenage, GB, vol. 51, No. 4, Feb. 19, 2015, pp. 315-317.
Li Hongmei et al, "Design of EBG with fractal structure of PIFA" 2015 Asia-Pacific Microwave Conference (APMC), IEEE, vol. 3, Dec. 6, 2015, pp. 1-3.
Shengying Liu, et al. "A broadband fractal AMC ground plane for low-profile antennas" Millimeter Waves (GSMM), 2012 5$^{th}$ Global Symposium on, IEEE, May 27, 2012, pp. 70-73.
Zhou L. et al., "Multiband Subwavelength Magnetic Reflectors based on Fractals" Applied Physics Letters, A I P Publishing LLC, US, vol. 83, No. 16, Oct. 20, 2003, pp. 3257-3259.
Martinis M. et al., "Wideband antenna in Cavity Based on Metasurfaces" IEEE Antennas and Wireless Propagation Letters, vol. 15, Oct. 15, 2015, pp. 1053-1056.
Joubert J. et al., "CPW-Fed Cavity—Backed Slot Radiator Loaded With an AMC Reflector" IEEE Transactions on Antennas and Propagation, IEEE Service Center, Piscataway, NJ, vol. 60, No. 2, Oct. 21, 2011, pp. 735-742.

* cited by examiner

ENHANCED ANTENNA SYSTEMS

CROSS-REFERENCE TO RELATED APPLICATION

This application is the National Stage of International Application No. PCT/US2017/055367, filed on Oct. 5, 2017, which claims priority to U.S. provisional patent application 62/404,273, entitled "Enhanced In-Cavity Antenna System," filed 5 Oct. 2016. The entire contents of the above-referenced applications are incorporated herein by reference.

BACKGROUND

The prior art does not describe antenna systems that perform well within shallow metal cavities or adjacent to conductive surfaces, generally because the metal is too close and produces a transmission line effect. The metal or conductive surface commonly produces an out of phase RF component that produces phase cancellation with the antenna signal. This transmission line effect typically severely degrades radiative performance of the antennas, especially in the far field.

SUMMARY

Antenna systems according to the present disclosure provide means of mitigating the undesirable transmission line effect(s) by using fractal metamaterials in close proximity to an antenna, with both the antenna and fractal metamaterials being positioned a conductive surface, which may be inside or adjacent to a cavity. The fractal metamaterial can include an array of close spaced (e.g., less than 1/10 wavelength separation) resonant structures of a fractal shape, resonant at or near the intended frequency of use of the antenna. The fractal metamaterial can reverse the phase of the reflected wave so that the metal cavity no longer produces an out of phase current induced by the antenna. Without the cavity being out of phase to the antenna, the transmission line effect is mitigated substantially and the antenna performance can accordingly be enhanced. Further embodiments omit a cavity and locate a fractal metamaterial and antenna(s) adjacent to an underlying conductive surface.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Figure 1:
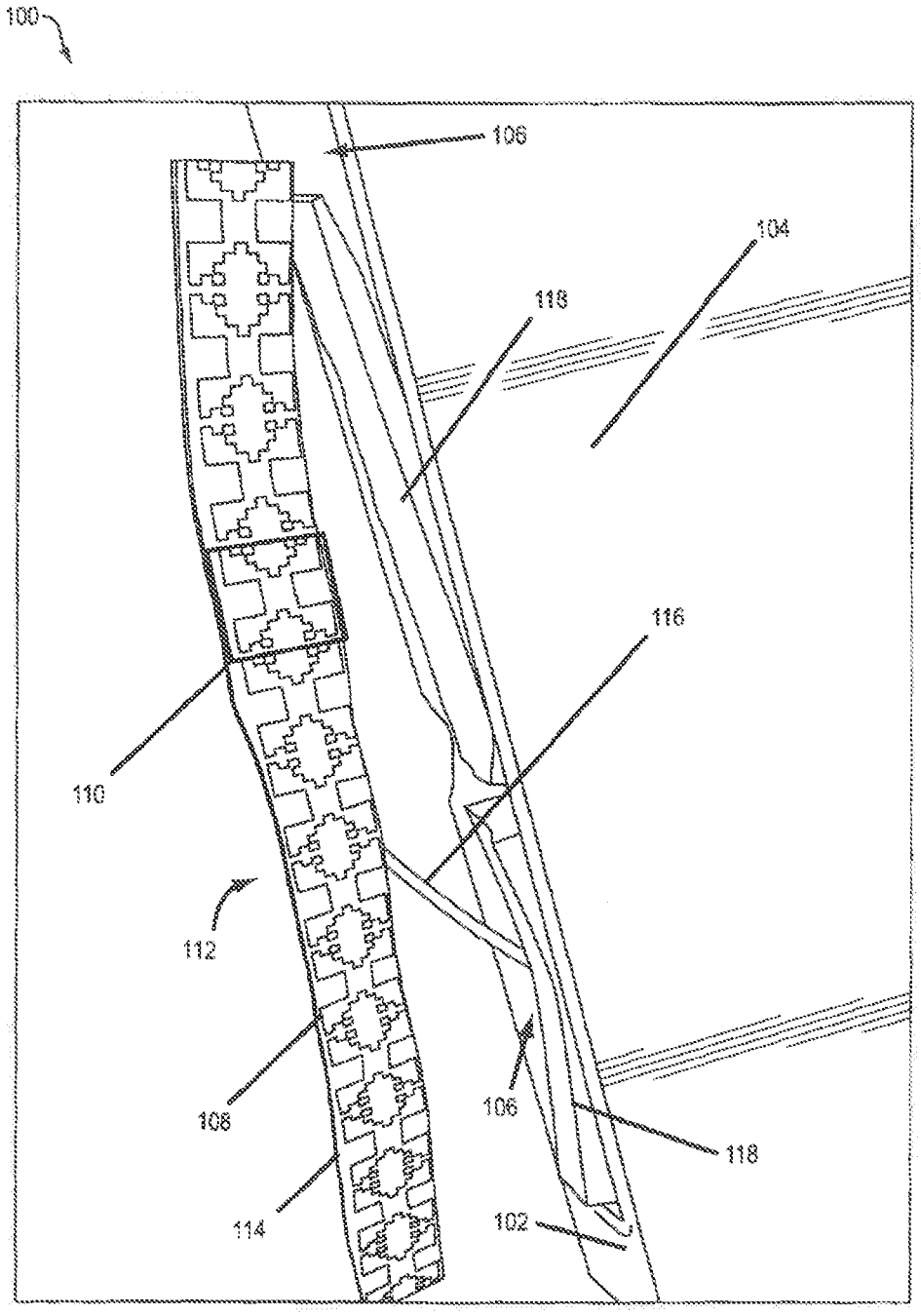
FIG. 1 depicts an embodiment of an antenna system including antenna and array utilized with a cavity.

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Systems according to the present disclosure can provide a means/way of mitigating the adverse transmission line issues, described above for the prior art, by using fractal metamaterials in close proximity to the antenna. As used herein, the term "close proximity," can mean, e.g., less than about 1/8 of a wavelength of electromagnetic energy received or transmitted by the antenna. The fractal metamaterial can include an array of close spaced (e.g., less than about 1/10 wavelength separation) resonant structures of a fractal or fractal-like shape, resonant at or near the intended frequency of use of the antenna. The fractal metamaterial reverses the phase of the reflected wave so that the conductive surface (e.g., metal of a cavity) no longer produces an out of phase current induced by the antenna. Without the conductive surface being out of phase to the antenna, the transmission line effect is mitigated substantially and the antenna performance is enhanced.

A fractal resonator can be either a conductive trace or a slot having a fractal or fractal-like perimeter. A fractal resonator includes a minimum of at least two fractal iterations, which form at least a portion of the resonator. The array can be stacked or positioned adjacent to the antenna itself, preferably with a dielectric separator. The array (fractal metamaterial) is itself separated from the bottom of the cavity or underlying surface by a dielectric. Any suitable dielectric (including air or other gas) can be used for this purpose. The stack may be 'sandwiched' together and incorporated as a single component, including the antenna. An exemplary embodiment has the separation of the antenna in a layered and stacked structure, which can be inserted to some extent in the cavity; preferably, but not necessarily, the antenna itself is the only portion of the stacked structure that is not inserted into the cavity but instead is coplanar or parallel to the surface in which the cavity is located.

Embodiments of the present disclosure provide for a decrease in the transmission line effect noted for the prior art—for which the metal or conductive surface adjacent the antenna produces an out of phase RF component that produces phase cancellation with the antenna signal—by utilizing an intervening layer or layers having an array of close-spaced or close-packed fractal resonators. Those resonators may be disposed on or in a substrate. Due to the presence of the array, although the antenna is still very close to the metal or conductive surface (of a surface, structure, or a cavity), the intervening fractal array layer is mitigates the out-of-phase effect. An example of how this may be accomplished is in the context of a two- or multiple-layer circuit board where the fractal-array layer or layers are included in lower layers between the antenna and the metal or conductive surface (of a surface, structure, or a cavity).

The fractal layer can include an array (regular or irregular) of closely-spaced fractal cells on a substrate. At least a portion of each fractal cell can be defined by or includes a self-similar structure, where aspect to it such that portions of the structure are similar to each other at different size-resolutions. The fractal cells are placed so that their separation in wavelengths at the lowest operational frequency of use is small relative to the wavelength, e.g., far less than a $10^{th}$ (1/10) of a wavelength. For multiband antennas and or wideband antennas the desired enhancement of performance can be accomplished or facilitated by multiple layers of these arrays having fractal-based cells.

FIGS. 1-4 illustrate exemplary embodiments of the novel technology of the present disclosure.

Figure 2:
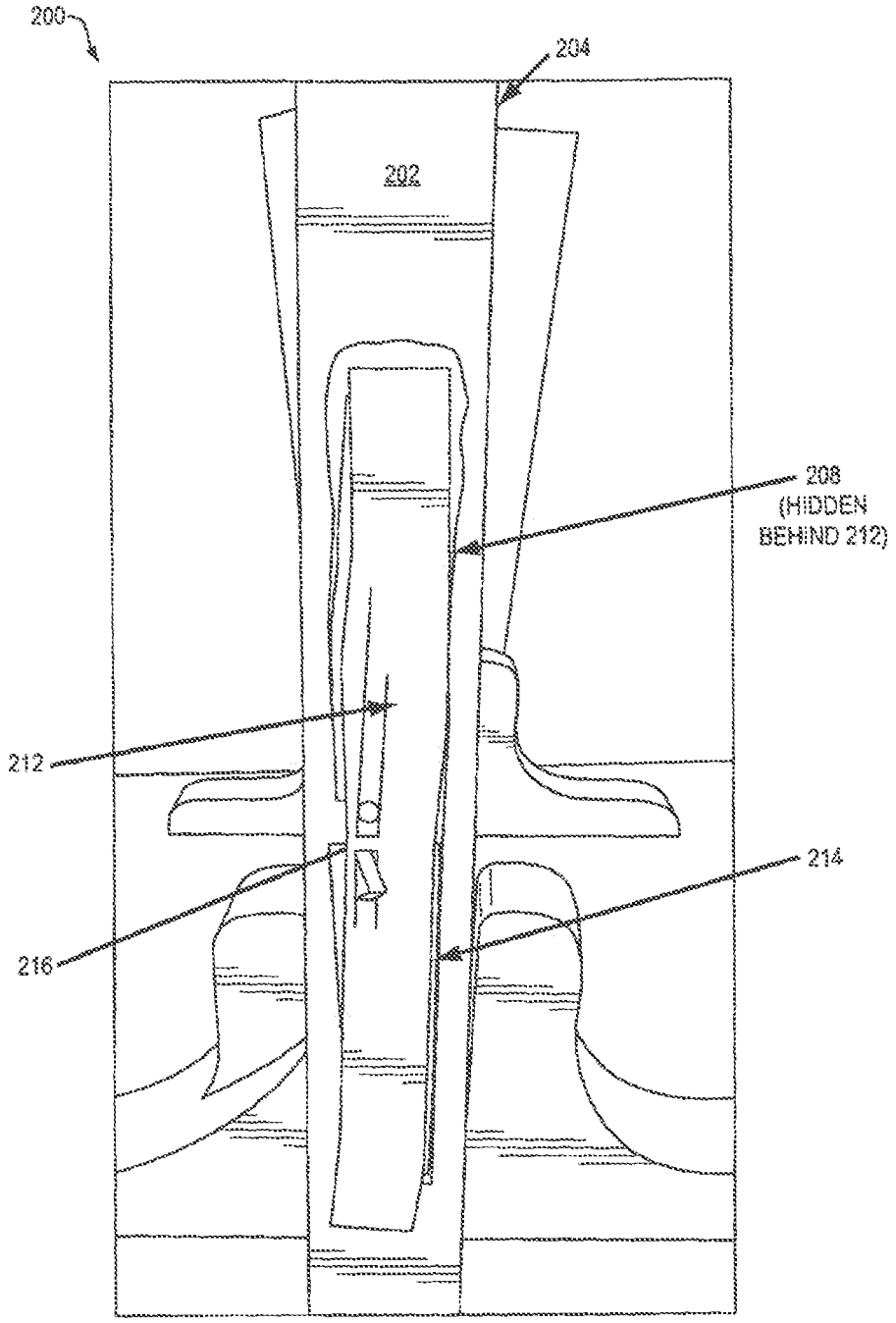
FIG. 2 depicts an embodiment of an antenna system including antenna and array utilized with a planar surface without a cavity.

FIGS. 1-2 show two exemplary embodiments of antenna system 100, 200, respectively, according to the present disclosure. In each, a metallic or conductive surface can be utilized to receive both an antenna (e.g., monopole, dipole, array of monopoles and/or dipoles, etc.) and an array of fractal features. FIG. 1 depicts an embodiment in which the antenna and array are utilized with a cavity; FIG. 2 depicts an embodiment in which the antenna and array are utilized with a planar surface without a cavity.

As shown in FIG. 1, system 100 can include a surface 102 of an object 104, e.g., a metallic object or structure. Surface 102 can include a recess or cavity 106 as shown. System 100 includes array 108 of fractal features, e.g., resonant structures such as closed traces or cells 110. An antenna 112, e.g., a dipole, is positioned within relatively close proximity to the array 108. In exemplary embodiments, the array 108 and antenna 112 (hidden in the figure) can be positioned in opposites of a substrate 114, e.g., as shown. In other embodiments, the array 110 and antenna 112 can be positioned or mounted on different structure(s). Feedline 116 is shown for feeding the antenna 112 with desired EM energy (e.g., a RF signal). Dielectric material 118 may be placed in the cavity, as shown, to facilitate achieving desired performance characteristics of the antenna 112.

As shown in FIG. 2, an antenna system 200 according to the present disclosure need not include a cavity. System 200 can include a surface 202 of an object 204, e.g., a metallic object or structure. System 200 includes an array 208 of fractal features similar to 110 in FIG. 1, e.g., resonant structures such as slots or closed traces. An antenna 212, e.g., a dipole, is positioned within relatively close proximity to the array 208. In exemplary embodiments, the array 208 (hidden in the figure) and antenna 212 can be positioned in opposites of a substrate 214, e.g., as shown. In other embodiments, the array 210 and antenna 212 can be positioned or mounted on different structure(s). Feedline 216 is shown for feeding the antenna 212. Dielectric material 218 may be placed between the surface 202 and array 208, as shown, to facilitate achieving desired performance characteristics of the antenna 212.

Figure 3:
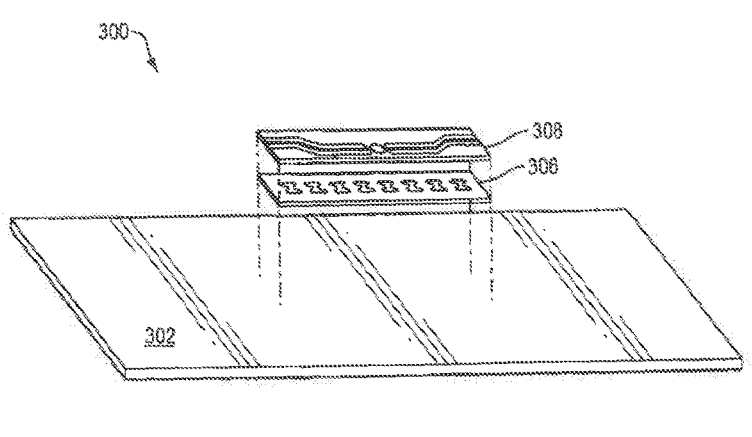
FIG. 3 depicts a line diagram of a perspective exploded view of an embodiment of an antenna system devoid of a cavity, in accordance with the present disclosure.

FIG. 3 depicts a line diagram of a perspective exploded view of an embodiment of an antenna system 300 devoid of a cavity, in accordance with the present disclosure. As shown, system 300 can include a conductive surface 302. An array of fractal elements (e.g., a fractal metamaterial) 306 is positioned adjacent to the surface 302. An antenna 308 is positioned adjacent to the array 306. The surface 302 can be curved or flat or include a combination of such features. The surface 302 can be metal, metallic, made of a conductive material or include any of such. The surface 302 can act as or similar to a ground plane but does not necessarily need to have a large extent in any direction vis-a-vis the size or dimensions of the array 306 and/or antenna 308.

Figure 4:
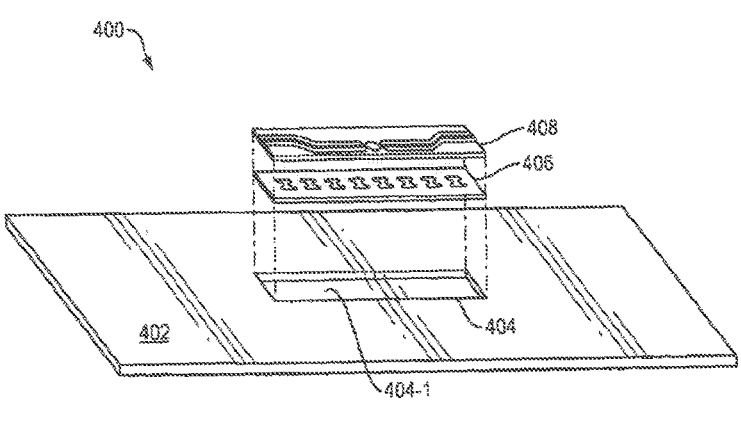
FIG. 4 depicts a line diagram of a perspective exploded view of an embodiment of an antenna system including a cavity, in accordance with the present disclosure.

FIG. 4 depicts a line diagram of a perspective exploded view of an embodiment of an antenna system 400 including a cavity 404, in accordance with the present disclosure. Cavity 404 includes an interior surface, e.g., including a flat planar surface 404-1 as shown, which may have the same or similar conductive characteristics as surface 402. As shown, system 400 can include a conductive surface 402 and a cavity 404 disposed in the surface 402. An array of fractal elements (e.g., a fractal metamaterial) 406 is positioned adjacent to the cavity 404. An antenna 408 (generally depicted as a dipole) is positioned adjacent to the array 406. The surface 402 and cavity can be curved or flat or include a combination of such features. The surface 402 can be metal, metallic, made of a conductive material or include any of such. The surface 402 can act as or similar to a ground plane but does not necessarily need to have a large extent in any direction vis-a-vis the size or dimensions of the array 406 and/or antenna 408.

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

For example, while some of the above-description and drawings have indicated preferred use of dipole antenna elements, a person of ordinary skill in the art would appreciate that other suitable antenna elements may be used. For example, monopoles, arrays of monopoles and/or dipoles, and slots, helix, meanders, fractals, patch, Vivaldi, inverted F, or space filling curves can be used. Further, any suitable conductive and/or dielectric materials can be used within the scope of the present disclosure examples including, but not limited to, phenolics, FR4, ceramics, RT Duroid 6002, PTFE, RO4730, Rogers RO 3200, and the like. Conductive materials can include, but are not limited to, copper, silver, gold, aluminum, suitable semi-conductor materials, printable inks, etc.

Exemplary clauses: the following clauses described certain exemplary embodiments of the present disclosure.

An antenna system including:

a single or multiband antenna in close proximity or inside a metal cavity for which phase cancellation limits the gain performance at one or more bands, in which one or more intervening array layers each having an array of close-spaced fractal resonators, supported on substrates, are placed to decrease the phase cancellation of the antenna and metal cavity combination.

An antenna system including:

a single or multiband antenna in close proximity to a metal surface for which phase cancellation limits the gain performance at one or more bands, in which one or more intervening array layers each having close-spaced fractal resonators, supported on a substrate or substrates, are placed to decrease the phase cancellation of the antenna and metal surface combination.

A laminated assembly of layers of the antenna system of claim 1.

A laminated assembly of layers of the antenna system of claim 2.

The system of claim 1, wherein the antenna is positioned within a range of between about 1/10 and 1/8 of the longest operational wavelength of the antenna to the one or more array layers.

The system of claim 2, wherein the antenna is positioned within a range of between about 1/10 and 1/8 of the longest operational wavelength of the antenna to the one or more array layers.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. An antenna system comprising:

a single or multiband antenna, disposed in close proximity or inside a metal cavity, for which phase cancellation limits a gain performance at one or more bands;

one or more intervening array layers disposed between the antenna and a surface of the metal cavity, wherein each intervening array layer has an array of close-spaced resonators, wherein each resonator has a portion that is a finite iteration fractal, wherein each intervening array layer is supported in or on one or more substrates; and wherein the one or more intervening array layers are placed to decrease the phase cancellation of the antenna and metal cavity combination.

2. A laminated assembly of layers of the antenna system of claim 1.

3. The system of claim 1, wherein the antenna is positioned within a range of between about 10 and of the longest operational wavelength of the antenna to the one or more array layers.

4. An antenna system comprising:

a single or multiband antenna, disposed in close proximity to a metal surface, for which phase cancellation limits a gain performance at one or more bands one or more intervening array layers disposed between the antenna and the metal surface, wherein each intervening array layer has close spaced fractal resonators, wherein each resonator has a portion that is a finite iteration fractal, wherein each intervening array layer supported in or on one or more substrates; and wherein the one or more intervening array layers are placed to decrease the phase cancellation of the antenna and metal surface combination.

5. A laminated assembly of layers of the antenna system of claim 4.

6. The system of claim 4, wherein the antenna is positioned within a range of between about 1/10 and 1/8 of the longest operational wavelength of the antenna to the one or more array layers.

* * * * *